US005749221A

United States Patent [19]

Kawahira et al.

[11] Patent Number: 5,749,221

[45] Date of Patent: May 12, 1998

[54] AIR-FUEL RATIO CONTROL SYSTEM AND METHOD THEREOF

[75] Inventors: Izuru Kawahira, Musashino; Yoshihiko Miyachi, Kunitachi, both of Japan

[73] Assignee: Fuji Jukogyo Kabushiki Kaisha, Tokyo, Japan

[21] Appl. No.: 753,976

[22] Filed: Dec. 4, 1996

Related U.S. Application Data

[63] Continuation of Ser. No. 383,378, Feb. 3, 1995, abandoned.

[30] Foreign Application Priority Data

Feb. 9, 1994 [JP] Japan ..... 6-015068

[51] Int. Cl.[6] ..... F01N 3/20

[52] U.S. Cl. ..... 60/274; 60/276; 60/285; 123/692

[58] Field of Search ..... 60/274, 276, 285; 123/692

[56] References Cited

U.S. PATENT DOCUMENTS 4,984,551 1/1991 Moser ..... 123/692

5,228,287 7/1993 Kuronishi et al. ..... 60/276

5,341,788 8/1994 Uchida ..... 123/692

5,417,058 5/1995 Shimizu ..... 60/276

FOREIGN PATENT DOCUMENTS 5-272382 10/1993 Japan .

*Primary Examiner*—Douglas Hart

*Attorney, Agent, or Firm*—Beveridge, DeGrandi, Weilacher & Young, L.L.P.

[57] ABSTRACT

In a horizontally opposed type engine, right and left exhaust pipes are provided for right and left cylinder banks, respectively and a collecting pipe is disposed to collect gases these two exhaust pipes. Further, in a two-stage catalytic converter system, two main catalysts are provided for the two exhaust pipes, respectively, and a subsidiary catalyst is provided in the collecting pipe. An oxygen sensors is provided in each of the exhaust pipes on the upstream side of it's main catalyst. The air-fuel ratios of both the banks are controlled simultaneously on the basis of the output of one of the sensors, and the air-fuel ratio of the other bank is corrected on the basis of a difference between the outputs of the two oxygen sensors. Accordingly, the air-fuel ratios of both right and left banks can be controlled appropriately, without the use of an auxiliary oxygen sensor. As a result, it is possible to improve the purification capability of the auxiliary catalyst in the collecting pipe.

17 Claims, 5 Drawing Sheets

AIR-FUEL RATIO CONTROL SYSTEM AND METHOD THEREOF

This application is a continuation of application Ser. No. 08/383,378, filed Feb. 3, 1995, which application is entirely incorporated herein by reference, and now abandoned.

BACKGROUND OF THE INVENTION

1. Field of the Invention

The present invention relates to an air-fuel ratio control system and method for an automotive vehicle having an engine provided with a catalyst, and more specifically to an air-fuel ratio feedback control method for an engine having a plurality of banks (e.g., horizontal opposed type, V-type, etc.) on the basis of oxygen sensors arranged in an exhaust gas purification system.

2. Description of the Prior Art

In the case of a horizontal opposed type engine, for instance, a plurality of cylinders are divided into right and left banks, and therefore the suction system is also divided into right and left intake pipes on the downstream side of a throttle valve, and the two intake pipes are connected to a plurality of the cylinders through an intake manifold. On the other hand, in the exhaust system, the plurality of the cylinders provided in the right and left banks are connected to the right and left exhaust pipes through the exhaust manifolds, and the right and left exhaust pipes are further combined into a single collecting pipe connected to one end of a muffler.

As the exhaust gas purification system for the above-mentioned engine, a catalytic converter system is well known such that main catalysts are provided in both right and left exhaust pipes, respectively, and an auxiliary catalyst is provided in the collecting pipe. Further, such an air-fuel ratio feedback control system has been so far proposed that: an oxygen sensor is provided for each of the right and left exhaust pipes; and the air-fuel ratio is determined for each bank on the basis of each of the right and left oxygen sensor signals to decide each fuel injection quantity. In this system, exhaust gas is purified by the main catalysts in the right and left exhaust pipes, and thereafter the exhaust gases from both the right and left banks are further purified by the auxiliary catalyst on the downstream side of the main catalysts.

In the air-fuel ratio control method of the prior art stated above, the air-fuel ratio is controlled for each bank. Therefore, even if a difference exists in air-fuel ratio or in sensor output phase or in sensor characteristics between the right and left banks, it is possible to control both the air-fuel ratios nearly at a stoichiometric value. The purification condition of the main catalyst can be optimized in this method. However, if a phase difference exists between the outputs of the two oxygen sensors, the following problem arises. That is, since the exhaust gases passing through the right and left exhaust pipes are collected at the upstream side of the auxiliary catalyst, the purification condition of the auxiliary catalyst tends to include a phase difference between the two oxygen sensor outputs, with the result that it is often impossible to obtain a sufficient purification function.

In more details, as shown in (a) and (b) of FIG. 6, if a phase difference exists between the outputs of the oxygen sensors of the right and left banks, exhaust gases passing through the right and left exhaust pipes are to be fed to the auxiliary catalyst under the condition that the phases of the rich-lean conditions are shifted from each other. Consequently, the two rich-lean conditions interfere with each other, so that periodical rich-lean variation cannot be obtained clearly as indicated in (c) of FIG. 6 at the auxiliary catalyst, thus causing a deterioration of the purification function. Accordingly, in the catalytic converter system having the main catalyst for each bank and the auxiliary catalyst for both banks (after collection), the air-fuel ratio at each of the three catalysts must be controlled at an optimum periodical rich-lean condition.

As a prior art example of the air-fuel ratio control system for an engine having a plurality of banks, Japanese Laid-Open Patent Publication No. 64-8332 discloses that the air-fuel ratio is controlled by feedback for each cylinder group independently on the basis of the oxygen sensor signal. Further, in order to solve the problem related to the phase difference in the air-fuel ratio between the respective cylinder groups, an auxiliary oxygen sensor is additionally provided at the downstream side of the collected portion of the exhaust pipes, and any one of the feedback correction coefficients is corrected on the basis of the auxiliary oxygen sensor so that the air-fuel ratios of the respective cylinder groups can be equalized.

As a second prior art example of the air-fuel ratio control system for an engine having a plurality of banks, Japanese Laid-Open Patent Publication No. 3-26845 discloses that three air-fuel ratio sensors are provided in the same way as that of the first example, and the air-fuel ratios of the two banks are controlled by feedback independently on the basis of each output of the three air-fuel ratio sensors. Further, one of the banks is adjusted on the basis of the output of the auxiliary air-fuel ratio sensor, and the other of the banks is adjusted on the basis of a relative phase difference in the air-fuel ratio between the two banks so that the control phase difference between both the banks can be eliminated.

Further, as a third prior art example of the air-fuel ratio control system for an engine having a plurality of banks, Japanese Laid-Open Utility Model Publication No. 63-79449 discloses that a main air-fuel ratio sensor is provided in one of the exhaust pipes, an auxiliary air-fuel ratio sensor is provided in the collecting pipe. The air-fuel ratios of the two banks then are controlled by feedback to the same level on the basis of the main air-fuel ratio sensor signal and further corrected on the basis of the auxiliary air-fuel ratio sensor signal.

In the above-mentioned three prior art systems, however, an auxiliary oxygen sensor is additionally provided in the collecting pipe, so that the number of the oxygen sensors increases. Further, in the first and second examples, the air-fuel ratios of the two banks are controlled independently and so corrected on the basis of the auxiliary oxygen sensor signals so that the phase difference in the air-fuel ratio between the banks can be eliminated. Therefore, the control system is rather complicated. Further, in the third example, two air-fuel ratios of the two banks are controlled on the basis of the same control variable when the distribution of the air-fuel ratio is not uniform. This causes a problem in that the air-fuel ratio of the other bank cannot be controlled appropriately.

SUMMARY OF THE INVENTION

In order to solve these problems, it is an object of the present invention to provide an air-fuel ratio control system and a method which can control the air-fuel ratios of both right and left banks, even if a difference exists between the right and left oxygen sensors, without using any additional auxiliary oxygen, sensors, and which can improve the purification function of the catalyst provided in the collecting pipe.

To achieve the above-mentioned object, the present invention provides an air-fuel ratio control system for an engine having first and second exhaust pipes for exhausting gas from first and second banks, respectively, and a collecting pipe for collecting the first and second exhaust pipes, the engine being provided with a catalytic converter, which comprises: first oxygen sensing means for detecting a first oxygen concentration in the first exhaust pipe; second oxygen sensing means for detecting a second oxygen concentration in the second exhaust pipe; air-fuel ratio discriminating means for discriminating a rich-lean condition in the first exhaust pipe on the basis of the first oxygen concentration; correction coefficient setting means for setting an air-fuel ratio feedback correction coefficient on the basis of the discriminated rich-lean condition; difference detecting means for detecting a difference between the first and second oxygen concentrations; correcting means for setting a correction coefficient Ke according to the detected difference; first fuel injection pulse width calculating means for calculating a first fuel injection pulse width for the first bank on the basis of a basic injection pulse width, the set air-fuel ratio feedback correction coefficient, and a first coefficient; and second fuel injection pulse width calculating means for calculating a second fuel injection pulse width for the second bank on the basis of the basic injection pulse width, the set air-fuel ratio feedback correction coefficient, the set correction coefficient, and a second coefficient.

Here, it is preferable that the control system further comprises: air-fuel ratio learning means connected to the correction coefficient setting means, for storing and updating an air-fuel ratio feedback correction coefficient determined according to engine operating conditions and for outputting a differential correction coefficient signal between a preceding value and a current value; and correction learning means connected to said correcting means, for storing and updating various correction coefficients determined according to various engine operating conditions and for outputting a correction coefficient signal on the basis of a preceding value.

Further, the present invention provides a method of controlling the air-fuel ratio for an engine having first and second exhaust pipes for exhausting gas from first and second banks, respectively, and a collecting pipe for collecting the first and second exhaust pipes, the engine being provided with a catalytic converter system, which comprises the steps of: detecting a first oxygen concentration in the first exhaust pipe; detecting a second oxygen concentration in the second exhaust pipe; detecting a difference between the detected first and second oxygen concentrations; setting a correction coefficient according to the detected difference; setting an air-fuel ratio feedback correction coefficient on the basis of the detected first oxygen concentration; controlling the air-fuel ratios of both the first and second banks on the basis of the air-fuel ratio feedback correction coefficient; and correcting an air-fuel ratio of the second bank on the basis of the air-fuel ratio feedback correction coefficient and the set correction coefficient.

DESCRIPTION OF THE PREFERRED EMBODIMENTS

Preferred embodiments of the present invention will become understood from the following detailed description referring to the accompanying drawings.

Figure 1:
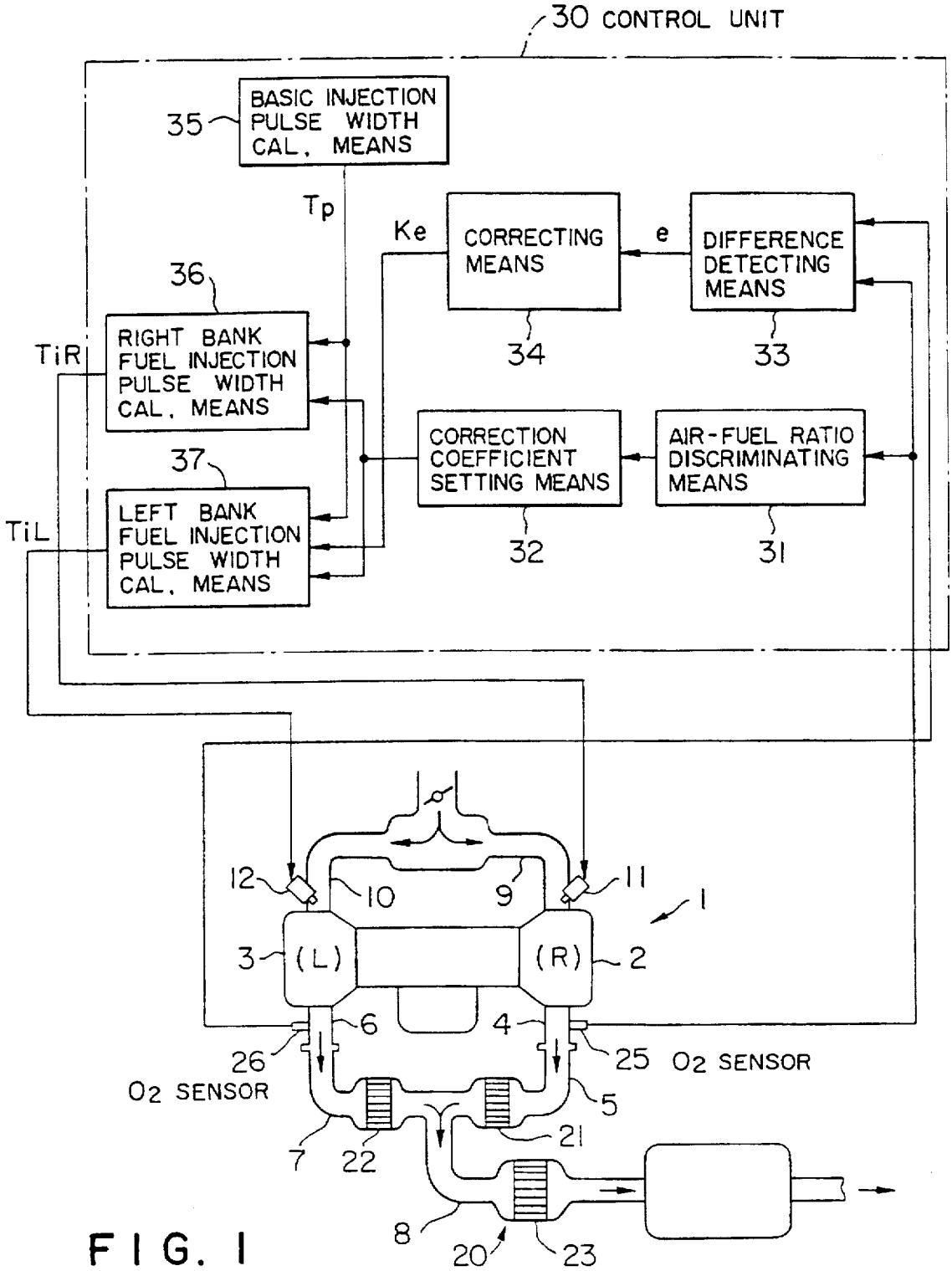
FIG. 1 is a block diagram showing an embodiment of an entire air-fuel system according to the present invention.

With reference to FIG. 1, a system for controlling an air-fuel ratio in a horizontally opposed type engine will be described below. The horizontally opposed type engine 1 is divided into a right bank 2 having three cylinders (e.g., #1, #3 and #5) and a left bank 3 having three cylinders (e.g., #2, #4 and #6). In the exhaust system, the respective cylinders in the right bank 2 communicate with a right exhaust pipe 5 through an exhaust manifold 4, and in the same way the respective cylinders in the left bank 3 communicate with a left exhaust pipe 7 through an exhaust manifold 6. Further, the right and left exhaust pipes 5 and 7 are connected to a collecting pipe 8. Further, injectors 11 and 12 are disposed on intake manifolds 9 and 10 of the right and left banks 2 and 3, respectively for fuel injection.

The horizontally opposed type engine has a triple catalytic converter system 20. The catalytic system 20 comprises two main catalysts 21 and 22 provided in the right and left exhaust pipes 5 and 7, respectively in an upstream portion of the collecting pipe 8, and further one auxiliary catalyst 23 provided in the collecting pipe 8 in a downstream portion thereof, so as to constitute a two-stage catalytic system. Accordingly, toxic components in the exhaust gas from the six cylinders in the right and left banks 2 and 3 can be purified through the three catalysts 21 to 23.

In the air-fuel ratio control system, two oxygen sensors 25 and 26 are arranged on the upstream sides of the main catalysts 21 and 22 in the right and left exhaust pipes 5 and 7, respectively, to detect an air-fuel ratio (rich or lean) of the exhaust gas on the basis of the oxygen concentration thereof. Respective outputs of the two oxygen sensors 25 and 26 are inputted to a control unit 30 for feedback controlling the air-fuel ratios of the right and left banks 2 and 3, respectively.

The principle of the air-fuel ratio feedback control will be described below. First, when the air-fuel ratios of the right and left banks 2 and 3 are controlled simultaneously on the basis of the output of only the right oxygen sensor 25, the rich/lean variation periods of the exhaust gases in both the right and left exhaust pipes 5 and 7 synchronize with each other, and the same periodical rich/lean variation is repeated clearly in the exhaust gas collected in the collecting pipe 8, so that the purification condition for the auxiliary catalyst 23 is optimized. In this case, the air-fuel ratio of the right bank 2 can be controlled in the vicinity of the stoichiometric air-fuel ratio value by the right oxygen sensor 25, so that the purification condition of the main catalyst 21 is also optimized.

When the output of the left oxygen sensor 26 is detected under the condition that the right oxygen sensor 25 detects the oxygen concentration at the stoichiometric air-fuel ratio, it is possible to discriminate a difference in the air-fuel ratio between both the banks 2 and 3 on the basis of a difference between the output signals of the two oxygen sensors 25 and 26. Therefore, when the air-fuel ratio of the left bank 3 is controlled on the basis of the difference between the outputs of the two oxygen sensors 25 and 26, it is also possible to control the air-fuel ratio of the left bank 3 roughly at the stoichiometric air-fuel ratio, so that the purification condition of the main catalyst 22 can be optimized.

With reference to FIG. 1, a control unit 30 decides the fuel injection quantity, the ignition timing, etc. The control unit 30 comprises air-fuel ratio discriminating means 31, correction coefficient setting means 32, difference detecting means 33, correcting means 34, basic fuel injection pulse width calculating means 35, fuel injection pulse width calculating means 36 for the right bank, and fuel injection pulse width calculating means 37 for the left bank, respectively.

The output of the oxygen sensor 25 of the right bank 2 is inputted to the air-fuel ratio discriminating means 31. After the engine 1 is started and warmed up, the exhaust gas can be purified by the catalysts. Therefore, the air-fuel ratio discriminating means 31 discriminates the rich/lean condition of the exhaust gas on the basis of the output signal of the oxygen sensor 25 of the right bank 2. The discriminated result is inputted to the correction coefficient setting means 32. The correction coefficient setting means 32 sets an appropriate air-fuel ratio feedback correction coefficient LAMBDA according to the discriminated result. The outputs of the two oxygen sensors 25 and 26 of the right and left banks 2 and 3 are inputted to the difference detecting means 33. The difference detecting means 33 detects a difference e between the two output signals of the two oxygen sensors 25 and 26, that is, an offset in rich or lean condition between both the banks 2 and 3 on the basis of the outputs of the two oxygen sensors 25 and 26. The detected difference is inputted to the correcting means 34. The correcting means 34 determines an appropriate correction coefficient Ke according to the detected difference between both the sensor signals, that is, the offset of the air-fuel ratio between both the banks 2 and 3.

On the other hand, various engine operating conditions such as an intake air quantity detected by an air flow meter, an engine rotation speed detected by a crank angle sensor, etc. are inputted to the basic injection pulse width calculating means 35. The basic injection pulse width calculating means 35 calculates a basic injection pulse width Tp on the basis of the detected engine operating conditions. The calculated basic injection pulse width Tp and the air-fuel ratio feedback correction coefficient LAMBDA are inputted to the right-bank fuel injection pulse width calculating means 36. The injection pulse width calculating means 36 calculates an appropriate fuel injection pulse width TiR by use of another correction coefficient COEF as follows:

$$TiR=Tp\times LAMBDA\times COEF$$

An injection signal having the calculated fuel injection pulse width TiR is outputted to the injector 11 of the right bank 2.

Further, the basic injection pulse width Tp, the air-fuel ratio feedback correction coefficient LAMBDA and the correction coefficient Ke are inputted to the left-bank fuel injection pulse width calculating means 37. The injection pulse width calculating means 37 calculates an appropriate fuel injection pulse width TiL by use of another correction coefficient COEF as follows:

$$TiL=Tp\times LAMBDA\times Ke\times COEF$$

An injection signal having the calculated fuel injection pulse width TiL is outputted to the injector 12 of the right bank 3.

The operation of the air-fuel ratio control system according to the present invention will be described below. First, when the engine is running, the exhaust gases of the right and left banks 2 and 3 flow through the right and left exhaust pipes 5 and 7, respectively, and are then passed through the main catalysts 21 and 22 of the catalytic converter system. Further, the exhaust gases in the right and left exhaust pipes 5 and 7 are collected by the collecting pipe 8. The collected mixed gas is further passed through the subsidiary catalyst 23. In the respective exhaust pipes 5 and 7, oxygen concentrations therein are detected separately by the two oxygen sensors 25 and 26 to obtain the air-fuel ratios of the right and left banks 2 and 3, respectively.

Here, the output of the right-bank oxygen sensor 25 is inputted to the air-fuel ratio discriminating means 31 of the control unit 30. After the engine has been warmed up and exhaust gas can be purified by the catalysts, the air-fuel ratio discriminating means 31 discriminates the rich/lean condition of the fuel on the basis of the sensor outputs. On the basis of the discriminated rich-lean condition, the correction coefficient setting means 32 sets the air-fuel ratio feedback correction coefficient LAMBDA. Further, on the basis of the basic injection pulse width Tp obtained by the basic injection pulse width calculating means 35 and the air-fuel ratio feedback correction coefficient LAMBDA set by the correction coefficient setting means 32, the right-bank fuel injection pulse width calculating means 36 calculates the fuel injection pulse widths TiR=Tp×LAMBDA×COEF. On the other hand, on the basis of the basic injection pulse width Tp obtained by the basic injection pulse width calculating means 35, the air-fuel ratio feedback correction coefficient LAMBDA set by the correction coefficient setting means 32 and the correction coefficient Ke obtained by the correcting means 34, the left-bank fuel injection pulse width calculating means 37 calculates the fuel injection pulse widths TiL=Tp×LAMBDA×Ke×COEF.

Both the injection signals indicative of the calculated fuel injection pulse widths are applied to the injectors 11 and 12, respectively, so that the fuel injection can be controlled according to the engine operating conditions and the air-fuel ratio conditions of both the banks 2 and 3.

Figure 2:
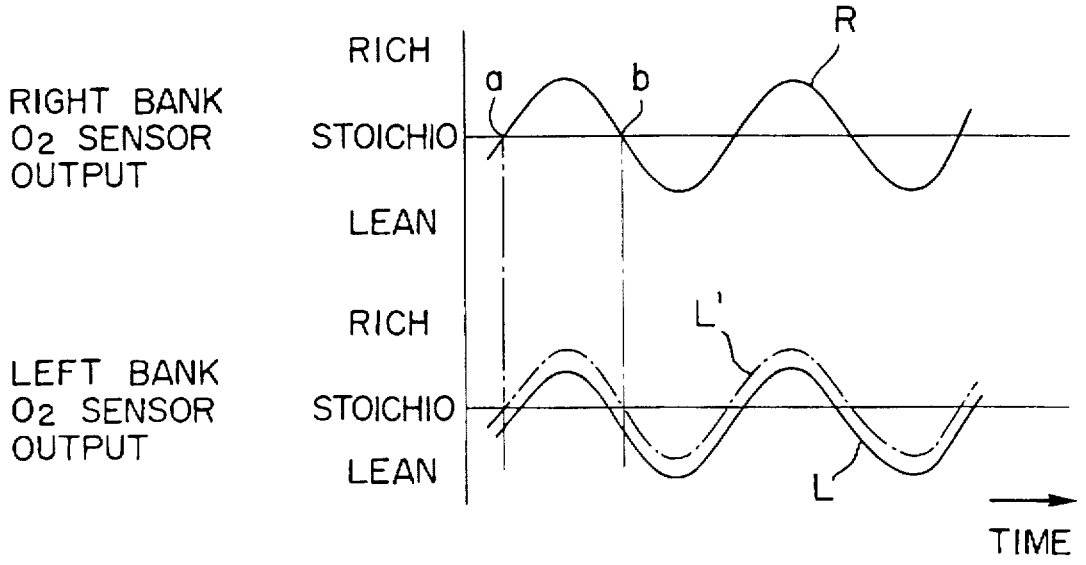
FIG. 2 illustrates waveform diagrams comparatively showing outputs of right and left oxygen sensors.

Accordingly, the air-fuel ratio of the right bank 2 can be feedback controlled as shown by a solid curve R in FIG. 2, in which rich/lean variation is repeated in the vicinity of the stoichiometric air-fuel ratio. Therefore, when the exhaust gas of the right bank 2 is passed through the main catalyst 21, toxic components of the exhaust gas can be purified effectively.

Under these conditions, the air-fuel ratio of the left bank 3 is also controlled simultaneously on the basis of the output signal of the oxygen sensor 25 of the right bank 2 in such a way that the rich-lean variation of the left bank 3 can be synchronized with the rich/lean variation of the right bank 2, as shown by a solid curve L in FIG. 2. Therefore, the exhaust gas collected at the collecting pipe 8 is passed through the auxiliary catalyst 23 at a stable rich/lean period, without any interference between the rich/lean conditions of both the banks. Under these conditions, sufficient catalytic function can be obtained through the auxiliary catalyst 23, so that it is possible to effectively eliminate toxic components of the exhaust gases for exhaust gas purification.

In the above-mentioned system, the difference detecting means 33 detects the difference in air-fuel ratio between both the banks 2 and 3 on the basis of the outputs of the two oxygen sensors 25 and 26 of the right and left banks 2 and 3, to correct the air-fuel ratio of the left bank 3. This correction control will be described in further detail below with reference to the flowcharts shown in FIGS. 3 and 4.

Figure 3:
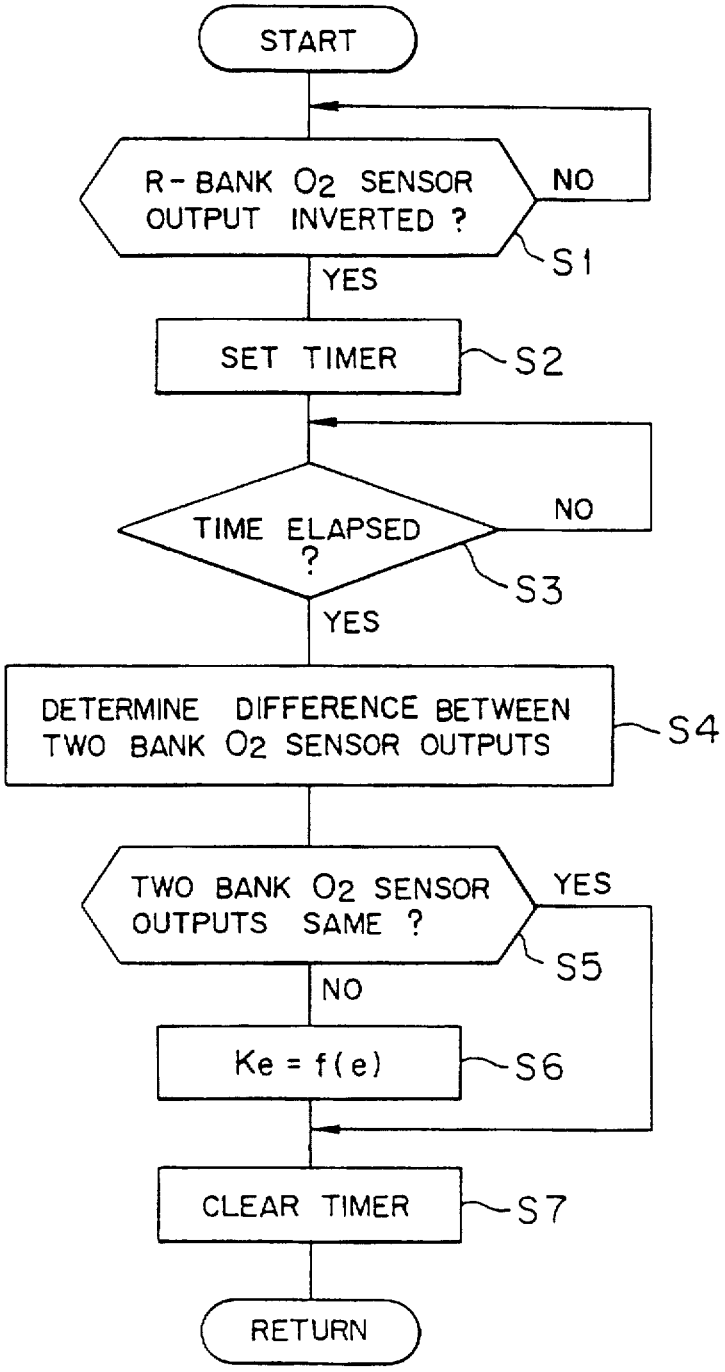
FIG. 3 is a flowchart showing a control procedure for detecting a difference between two oxygen sensors.

In FIG. 3, the control unit 30 (referred to as control, simply hereinafter) discriminates whether the output of the oxygen sensor 25 of the right bank 2 is inverted or not (in step S1). That is, when the sensor signal is inverted from a lean status to a rich status as shown by a point a or from a rich status to a lean status as shown by a point b in FIG. 2, the control discriminates that sensor output is inverted. The criterion (stoichiometric value) of this output inversion level can be replaced with a slice level determined at any intermediate level between the maximum rich value and the minimum lean value.

After having discriminated the output inversion in step S1, the control sets a timer (in step S2) and checks whether a predetermined time has elapsed after the sensor output has been inverted (in step S3). If YES, the step S3 proceeds to the succeeding steps to prevent hunting caused when the air-fuel ratio is corrected immediately after inversion of the sensor outputs. That is, the control detects the outputs of both the oxygen sensors 25 and 26 of both the banks 2 and 3 (in step S4). On the basis of the detected outputs, the control discriminates a difference in air-fuel ratio between the right and left banks 2 and 3 (in step S5).

Here, when the air-fuel ratio of the left bank 3 deviates to the lean side relative to that of the right bank 2, as shown by a solid curve L in FIG. 2, the output of the oxygen sensor 26 is lean on both the points a and b. Further, when the sensor characteristics of the left bank 3 are the same as those of the right bank 2, the air-fuel ratio may be the same on both the banks 2 and 3. Further, when the two sensor outputs are different in phase, in spite of the fact that both the banks are controlled simultaneously on the basis of only the output of the oxygen sensor 25 of the right bank 2 (as when lean at point a but rich at point b), this indicates an abnormality of the fuel system, so that it is also possible to utilize the phase difference detection as the diagnosis of the fuel system.

In the step S5 in which the difference condition of the air-fuel ratio of the left bank 3 relative to that of the right bank 2 is detected, if the air-fuel ratio of the left bank 3 is the same as that of the right bank 2 (i.e., the output values of both oxygen sensors 25 and 26 are the same on the rich or lean side), the control unit 30 clears the timer (in step S7), and ends the control procedure. On the other hands, when the air-fuel ratio of the left bank 3 is different from that of the right bank 2 (i.e., the output value of one of the oxygen sensors 25 and 26 is on the rich side and that of the other is on the lean side), the control determines a correction coefficient Ke (in step S6), and then clears the timer (in step S7). Here, when the air-fuel ratio deviates to the lean side as shown by the solid line curve L in FIG. 2, the correction coefficient Ke is set as Ke >1.

When the difference correction coefficient Ke is so set as Ke>1, the fuel injection pulse width TiL of the left bank 3 is calculated on the basis of this correction coefficient Ke, and the injection signal is outputted so that the air-fuel ratio can be corrected.

Figure 4:
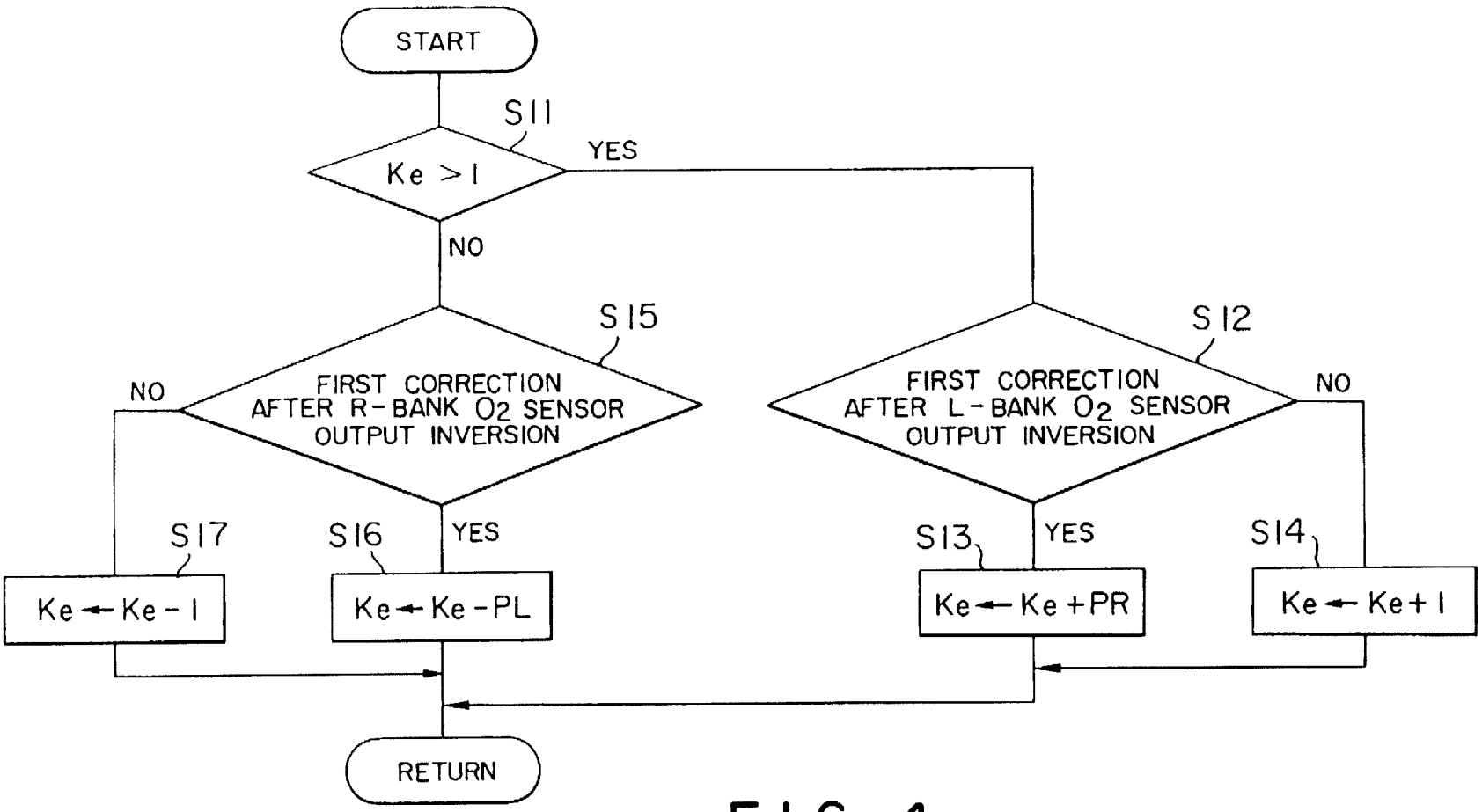
FIG. 4 is a flowchart showing a control procedure for setting a correction coefficient on the basis of the difference between the two oxygen sensors.

In more detail, with reference to FIG. 4, after the correction coefficient Ke has been set as Ke>1 (in step S11), the control unit 30 discriminates whether this correction is the first correction after the output of the oxygen sensor 25 of the right bank 2 has been inverted (in step S12). If YES, the control unit 30 increases the correction coefficient Ke at a large proportional rate (+PR) to correct the air-fuel ratio sharply (in step S13). However, if NO (the second and more times), the control unit 30 increases the correction coefficient Ke at a small integral rate (+I) to correct the air-fuel ratio gently (in step S14).

In contrast with this, when the air-fuel ratio is shifted to the rich side and thereby the correction coefficient is so set as Ke<1, control proceeds from step S11 to step S15 and further to step S16 or S17. That is, the control unit 30 discriminates whether this correction is the first correction after the output of the oxygen sensor 26 of the left bank 3 has been inverted (in step S15). If YES, the control unit 30 decreases the correction coefficient Ke at a large proportional rate (−PR) to correct the air-fuel ratio sharply (in step S16). However, if NO (the second and more times), the control unit 30 decreases the correction coefficient Ke at a small integral value (−I) to correct the air-fuel ratio gently (in step S17).

Under these conditions, the air-fuel ratio of the left bank 3 is corrected increasingly as shown by a dot-dashed curve L' in FIG. 2 so as to approach the air-fuel ratio of the bank 2. Accordingly, when the exhaust gas of the left bank 3 is passed through the main catalyst 22, the toxic components thereof can be purified effectively. As described above, in the catalytic converter system, the air-fuel ratios can be optimized at the two main catalysts 21 and 22 provided for the right and left banks 2 and 3 and the subsidiary catalyst 23 arranged on the collecting pipe (8) side, and toxic components of the exhaust gas can be purified most effectively through the two-stage purification, with the result that the overall exhaust gas purification efficiency can be improved.

Figure 5:
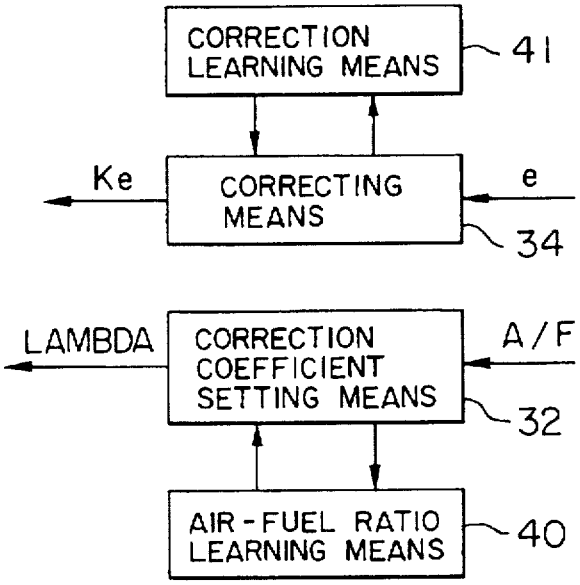
FIG. 5 is a block diagram showing a modification of the air-fuel ratio control system according to the present invention, in which learning means are additionally provided.
Figure 6:
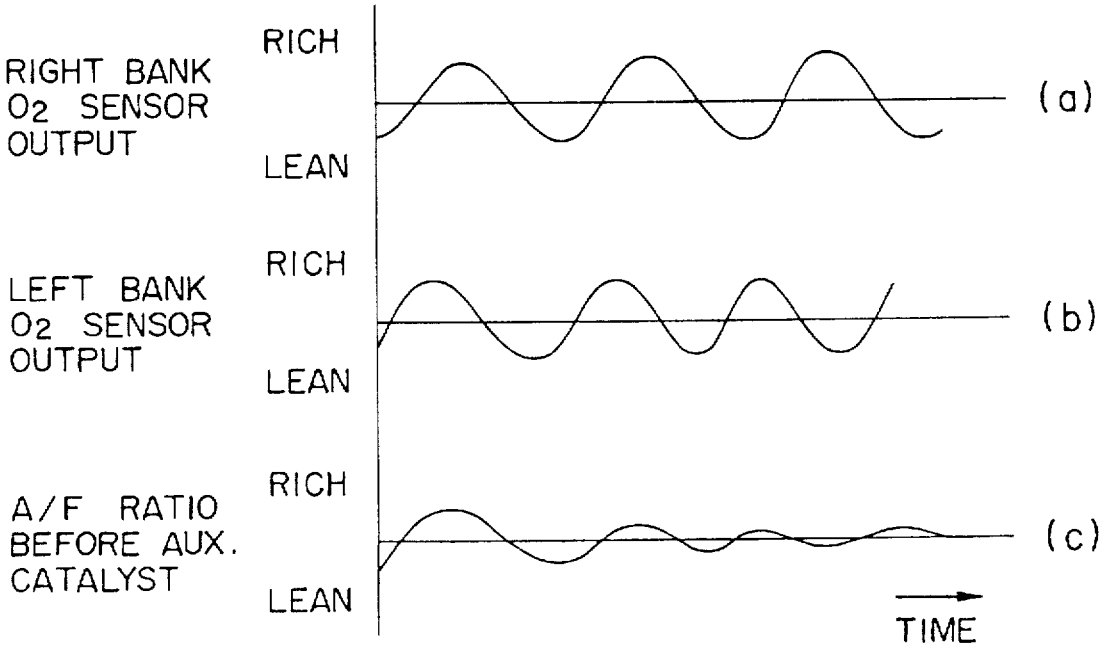
FIG. 6 PRIOR ART
FIG. 6 illustrates waveform diagrams showing oxygen sensor output signals indicative of rich-lean conditions of an auxiliary catalyst in the air-fuel control method of the prior art.

FIG. 5 shows a modification of the present invention, in which the air-fuel ratio is controlled in accordance with learning effects. This modification is basically the same as the system shown in FIG. 1, except air-fuel ratio learning means 40 is provided for the correction coefficient setting means 32, and correction learning means 41 is provided for the correcting means 34. The air-fuel ratio learning means 40 stores a learning map representative of the air-fuel ratio feedback correction coefficient values LAMBDA according to various operating conditions (engine speed, engine load, etc.) in such a way as to be updateable Therefore, the correction coefficient LAMBDA can be output on the basis of a difference between the preceding value and the current value, so that the response characteristics of the air-fuel ratio control can be further improved.

On the other hand, the correction learning means 41 stores the difference correction coefficient values Ke in the learning map, and the correction value is updated whenever the phase shift is corrected. Further, during correction, the learning is executed in such a way that the current correction is obtained by multiplying the preceding value by the updated value. Therefore, it is possible to minimize the fluctuations of the air-fuel ratio.

As described above, in the air-fuel ratio control system and the method according to the present invention for an engine having both right and left banks and provided with a catalytic converter system having two-stage main and auxiliary catalysts, an oxygen sensor is disposed for each exhaust pipe on the upstream side of the main catalyst; the air-fuel ratios of both the right and left banks are controlled simultaneously by the output of only one oxygen sensor; and further the air-fuel ratio of the other of the banks is corrected according to the difference between the outputs of the two oxygen sensors. Therefore, it is possible to control the air-fuel ratios of both the right and left banks appropriately on the basis of the difference between the two oxygen sensor outputs. Accordingly, the purification capability of the auxiliary catalyst in the collecting pipe can be further improved.

Further, the air-fuel ratios of both the banks can be controlled simultaneously on the basis of the output of one of the oxygen sensors for both the right and left banks, so that the control is simplified. In addition, since only two oxygen sensors are used, the number of oxygen sensors can be reduced. In addition, on the basis of the difference condition between the two oxygen sensor outputs, it is possible to find the causes thereof, so that it is possible to easily diagnose the fuel system.

Further, when the air-fuel control is executed in accordance with learning effects, the air-fuel ratio on the corrected bank side can be corrected on the basis of the actually learned correction coefficient. Therefore, it is possible to minimize the fluctuations of the air-fuel ratio.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. An air-fuel ratio control system for an engine having a first bank of cylinders, a second bank of cylinders, a first intake pipe connected to said first bank, a second intake pipe connected to said second bank, a first exhaust pipe connected to said first bank for exhausting gases from the first bank, a second exhaust pipe connected to said second bank for exhausting gases from the second bank, and a collecting pipe connected to both said first and second exhaust pipes for collecting said gases from said exhaust pipes, the air-fuel ratio control system comprising:

a first catalytic converter inserted in said first exhaust pipe for purifying said gases from said first bank;

a second catalytic converter inserted in said second exhaust pipe for purifying said gases from said second bank;

an auxiliary catalytic converter provided in said collecting pipe for further purifying said gases from both said first and second exhaust pipes;

first oxygen sensing means inserted in said first exhaust pipe for detecting a first oxygen concentration in the first exhaust pipe and for outputting a first oxygen concentration signal corresponding to said first oxygen concentration;

second oxygen sensing means inserted in said second exhaust pipe for detecting a second oxygen concentration in the second exhaust pipe and for outputting a second oxygen concentration signal corresponding to said second oxygen concentration;

air-fuel ratio discriminating means responsive to said first oxygen concentration signal for discriminating a rich-lean condition of said gases in the first exhaust pipe and for outputting a discriminating signal corresponding to the discriminated rich-lean condition;

feedback correction coefficient setting means responsive to said discriminating signal for setting an air-fuel ratio feedback correction coefficient on the basis of the discriminated rich-lean condition and for producing a feedback correction signal corresponding to said set air-fuel ratio feedback correction coefficient;

difference detecting means responsive to said first and second oxygen concentration signals for detecting a difference between the detected first and second oxygen concentrations and for generating a difference signal corresponding to said detected difference;

difference correcting means responsive to said difference signal for setting a difference correction coefficient according to the detected difference and for outputting a difference correction coefficient signal corresponding to the difference correction coefficient;

first bank fuel injection pulse width calculating means responsive to said feedback correction signal for calculating a first fuel injection pulse width for the second bank on the basis of a basic injection pulse width and the set air-fuel ratio feedback correction coefficient; and second bank fuel injection pulse width calculating means responsive to said feedback correction signal and said difference correction coefficient signal, for calculating a second fuel injection pulse width for the first bank on the basis of the set air-fuel ratio feedback correction coefficient and the set difference correction coefficient so as to effectively control the air fuel ratio of the engine at an optimum value for any operating condition of the engine.

2. The air-fuel ratio control system according to claim 1, wherein:

said feedback correction coefficient correction setting means includes air-fuel ratio learning means for storing and updating air-fuel ratio feedback correction coefficients determined according to various engine operating conditions and for outputting a differential feedback correction coefficient between a preceding feedback correction coefficient value and a current feedback correction coefficient value; and correction learning means in said difference correcting means, for storing and updating difference correction coefficients determined according to various engine operating conditions and for outputting a difference correction coefficient on the basis of a preceding difference correction coefficient.

3. A method of controlling an air-fuel ratio for an engine having a first bank of cylinders, a second bank of cylinders, a first intake pipe connected to said first bank, a second intake pipe connected to said second bank, a first exhaust pipe connected to said first bank for exhausting gases from the first bank, a second exhaust pipe connected to said second bank for exhausting gases from the second bank, and a collecting pipe connected to both said first and second exhaust pipes for collecting said gases from said exhaust pipes, comprising the steps of:

detecting a first oxygen concentration in the first exhaust pipe;

detecting a second oxygen concentration in the second exhaust pipe;

detecting a difference between the detected first and second oxygen concentrations;

setting a difference correction coefficient according to the detected difference;

calculating an air-fuel ratio feedback correction coefficient on the basis of the detected first oxygen concentration;

controlling air-fuel ratios of both the first and second banks on the basis of the air-fuel ratio feedback correction coefficient; and correcting an air-fuel ratio of the second bank on the basis of the air-fuel ratio feedback correction coefficient and the difference correction coefficient.

4. The method of controlling an air-fuel ratio according to claim 3, wherein the step of detecting a difference between the detected first and second oxygen concentrations includes:

detecting whether the first oxygen concentration is inverted at a predetermined level or not;

checking whether a predetermined time has elapsed after the first oxygen concentration is inverted; and measuring the difference between the detected first and second oxygen concentrations when the predetermined time has elapsed.

5. The method of controlling an air-fuel ratio according to claim 4, wherein the predetermined level is a stoichiometric air-fuel ratio value.

6. The method of controlling an air-fuel ratio according to claim 4, wherein the step of setting the difference correction coefficient according to the detected difference includes:

setting no difference correction coefficient if the detected difference is zero; and setting the difference correction coefficient if the detected difference is not zero.

7. The method of controlling an air-fuel ratio according to claim 6, wherein the step of setting the difference correction coefficient if the detected difference is not zero includes:

checking whether the difference correction coefficient is being set for a first time after the first oxygen concentration has been inverted at the predetermined level;

increasing an absolute value of the difference correction coefficient by a relatively large absolute value if the difference correction coefficient is being set for a first time after the first oxygen concentration has been inverted at the predetermined level; and increasing an absolute value of the difference correction coefficient by a relatively small absolute value if the correction is not being set for a first time after the first oxygen concentration has been inverted at the predetermined level.

8. The method of controlling an air-fuel ratio according to claim 7, wherein the relatively large absolute value is determined on the basis of a proportional rate.

9. The method of controlling an air-fuel ratio according to claim 7, wherein the relatively small absolute value is determined on the basis of an integral rate.

10. The method of controlling an air-fuel ratio according to claim 3, wherein the air-fuel ratio feedback correction coefficient is set in accordance with a learning effect in the step of setting an air-fuel ratio feedback correction coefficient on the basis of the detected first oxygen concentration.

11. The method of controlling an air-fuel ratio according to claim 3, wherein the difference correction coefficient is set in accordance with a learning effect in the step of setting a difference correction coefficient according to the detected difference.

12. A method of controlling an air-fuel ratio for an engine having, a first bank of cylinders, a second bank of cylinders, a first intake pipe connected to said first bank, a second intake pipe connected to said second bank, a first exhaust pipe connected to said first bank for exhausting gases from the first bank, a second exhaust pipe connected to said second bank for exhausting gases from the second bank, and a collecting pipe connected to both said first and second exhaust pipes for collecting said gases from said exhaust pipes, the method comprising:

arranging a first oxygen sensor in the first exhaust pipe and a second oxygen sensor in the second exhaust pipe, such that each sensor is on an upstream side of a main catalyst located in each of the pipes, respectively;

controlling air-fuel ratios of both the first and second banks on the basis of an output of the first oxygen sensor; and correcting an air-fuel ratio of the second bank according to a difference between outputs of the first and second oxygen sensors.

13. The method of controlling an air-fuel ratio according to claim 12, wherein the step of correcting the air-fuel ratio of the second bank comprises:

detecting the outputs of both the first and second oxygen sensors when a predetermined time has elapsed after inversion of the output of the first oxygen sensor;

discriminating a difference in conditions of the air-fuel ratios toward a rich or a lean side;

determining a difference correction coefficient according to the discriminated difference in conditions; and calculating a fuel injection pulse width of the second bank on the basis of the determined difference correction coefficient.

14. The method of controlling an air-fuel ratio according to claim 12, wherein the air-fuel ratio of the second bank is corrected on the basis of a learning effect of the difference between outputs of the two oxygen sensors in the step of correcting the air-fuel ratio of the second bank.

15. The air-fuel ratio control system recited in claim 1, wherein:

said first oxygen sensing means is positioned in said first exhaust pipe between said first bank and said first catalytic converter; and said second oxygen sensing means is positioned in said second exhaust pipe between said second bank and said second catalytic converter.

16. An air-fuel ratio control system for an engine having a first bank of cylinders, a second bank of cylinders, a first intake pipe connected to said first bank, a second intake pipe connected to said second bank, a first exhaust pipe connected to said first bank for exhausting gases from the first bank, a second exhaust pipe connected to said second bank for exhausting gases from the second bank, and a collecting pipe connected to both said first and second exhaust pipes for collecting said gases from said exhaust pipes, the air-fuel ratio control system comprising:

air-fuel ratio discriminating means for discriminating a rich-lean condition of said gases in the first exhaust pipe and for outputting a discriminating signal corresponding to the discriminated rich-lean condition;

feedback correction coefficient setting means responsive to said discriminating signal for setting an air-fuel ratio feedback correction coefficient on the basis of the discriminated rich-lean condition and for producing a feedback correction signal corresponding to said set air-fuel ration feedback correction coefficient;

difference detecting means for detecting a difference between a first oxygen concentration in the first exhaust pipe and a second oxygen concentration in the second exhaust pipe, and for generating a difference signal corresponding to said detected difference;

difference correcting means responsive to said difference signal for setting a difference correction coefficient according to the detected difference and for outputting a difference correction coefficient signal corresponding to the difference correction coefficient;

first bank fuel injection pulse width calculating means responsive to said feedback correction signal for calculating a first fuel injection pulse width for the second bank on the basis of a basic injection pulse width and the set air-fuel ratio feedback correction coefficient; and second bank fuel injection pulse width calculating means responsive to said feedback correction signal and said difference correction coefficient signal, for calculating a second fuel injection pulse width for the first bank on the basis of the set air-fuel ratio feedback correction coefficient and the set difference correction coefficient so as to effectively control the air fuel ratio of the engine at an optimum value for any operating condition of the engine.

17. The air-fuel ratio control system according to claim 16, wherein:

said feedback correction coefficient correction setting means includes air-fuel ratio learning means for storing and updating air-fuel ratio feedback correction coefficients determined according to various engine operating conditions and for outputting a differential feedback correction coefficient between a preceding feedback correction coefficient value and a current feedback correction coefficient value; and correction learning means in said difference correcting means, for storing and updating difference correction coefficients determined according to various engine operating conditions and for outputting a difference correction coefficient on the basis of a preceding difference correction coefficient.

* * * * *